US005350560A

United States Patent [19]

Kasiske

[11] Patent Number: 5,350,560

[45] Date of Patent: Sep. 27, 1994

[54] WEAR RESISTANT ALLOY

[75] Inventor: John M. Kasiske, Katy, Tex.

[73] Assignee: Triten Corporation, Houston, Tex.

[21] Appl. No.: 90,401

[22] Filed: Jul. 12, 1993

[51] Int. Cl.[5] ..... C22C 38/52; C22C 38/44

[52] U.S. Cl. ..... 420/38; 420/585

[58] Field of Search ..... 420/38, 585, 586.1; 148/327

[56] References Cited

U.S. PATENT DOCUMENTS 5,238,508 8/1993 Yoshitake et al. ..... 148/327

FOREIGN PATENT DOCUMENTS 60-165361 8/1985 Japan ..... 420/38

*Primary Examiner*—Deborah Yee

*Attorney, Agent, or Firm*—James F. Weiler

[57] ABSTRACT

Disclosed are iron based, austenitic alloys of substantially reduced cobalt content compared to current cobalt based alloys, such as Stellite 1 and 6, which are substantially less expensive than current cobalt based alloys, which are machinable using standard machine processes and procedures, which can be deposited as a hard surface with a tight crack pattern or a smooth surface, which does not stress crack upon cooling, which provides substantially reduced radiation exposure by plant maintenance workers in nuclear power plants, and which has a superior hardness, lower friction coefficiency, metal to metal wear loss and erosion loss than cobalt based alloys, such as Stellite 1 and Stellite 6. The alloying content comprises from about 38.0 to 62.0 percent by weight, and has a cobalt content of from about 3.00 to 9.00 percent by weight.

2 Claims, No Drawings

WEAR RESISTANT ALLOY

FIELD OF THE INVENTION

The present invention is in the field of wear resistant cobalt based alloys providing wear, erosion, and corrosion resistance surfaces to components of industrial equipment.

BACKGROUND OF THE INVENTION

Cobalt bearing hardfacing alloys are used to protect wear surfaces in industrial applications. Stellite, a product of Stoody Deloro, is the most common cobalt based alloy in current use, but it is very expensive and is not machinable by normal methods and procedures. Cobalt bearing surface alloys have good resistance to galling and to cavitation erosion, reasonably good resistance to abrasion and corrosion, and good weldability by plasma-transferredarc, gas-tungsten-arc, and gas-metal-arc welding, the processes most commonly used to apply these alloys. They are used for hardfacing to provide wear resistant surfaces. They are also used to protect wear surfaces in nuclear power plants; however, they are the source of close to 80 percent of all radiation exposure suffered by plant maintenance workers.

Further information concerning cobalt based alloys is set forth in an article entitled "The Search for Cobalt-Free Hardfacing Alloys" appearing in *Welding Design Fabrication*, July, 1989, pp. 46–49, which discusses cobalt free surfacing alloys.

The preferred method of hardfacing a surface with an alloy utilizes the bulkweld process of alloy powder and a wire or electrode melted together in a welding arc and simultaneously welded to a base plate or a component while melting an amount of the surface thereof to obtain a weld bond, such as set forth in U.S. Pat. No. 3,076,888. Other patents illustrating hardfacing are U.S. Pat. Nos. 3,000,094; 3,060,307; 3,062,948; 3,407,478; 3,494,749; 3,513,288; 3,517,156; 3,588,432; and 3,609,292.

It would be highly advantageous to provide a hardfacing alloy having a substantially reduced cobalt content than those in common use today, which is substantially less expensive over the more common cobalt based alloys; that is, an alloy which is about one-half to one-third the cost of other alloys having a cobalt base, and one which lends itself to being machined by standard tooling and equipment which is not possible with current cobalt based alloys in common use because they contain primary carbides. The alloy of the present invention does not develop primary carbides.

SUMMARY OF THE INVENTION

The present invention is directed to an alloy having significant advantages over current high content cobalt based alloys, such as Stellite, including a reduction in costs from current cobalt based alloys of about one-half to one-third, one that lends itself to being machined by standard tooling and equipment which is possible because unlike other alloys this alloy does not develop primary carbides which are not considered machinable by normal methods and procedures, and one that has a substantially reduced radiation exposure to plant personnel. Advantageously, the alloy can be applied by the so-called "bulkweld" process, both open and subarc, where a supplemental powder filler material is added to the welding arc of a consumable electrode, such as set forth in the foregoing patents and currently in use. The wear resistant alloy is useful for surfacing industrial components and one in which the complete part or component may be cast.

The alloy of the present invention is an iron based and fully austenitic alloy consisting of 38.0 to 62.0 percent alloying elements which include chromium, nickel, molybdenum, manganese, silicon, and not over about 9 percent by weight cobalt and may include incidental impurities. The alloy is weldable over existing cobalt based alloys, it is readily machinable using standard machine process, it is typically deposited with a tight crack pattern 0.005 inch, and can be made essentially "crack free."

A presently preferred alloy both for surfacing parts and for components comprises by weight percentages, 0.02–0.80 percent carbon, 0.50–3.00 percent manganese, 2.00–3.00 percent silicon, 20.00–30.00 percent chromium, 5.00–9.00 percent molybdenum, 7.0–9.00 nickel, 3.00–9.00 percent cobalt, and the balance being iron and incidental impurities.

Accordingly, it is an object of the present invention to provide an alloy of substantially reduced cobalt content and having superior properties to those of current cobalt hardfacing alloys, such as Stellite 1 and Stellite 6.

A further object of the present invention is the provision of such an alloy of substantially reduced costs, that is about half or less than the cost of current cobalt hardfacing alloys such as Stellite 1 and Stellite 6.

It is a further object of the present invention to provide such an alloy which may be added as a surface to industrial parts by welding, and by the bulkweld process.

It is a further object of the present invention to provide such an alloy which in addition to substantial cost reductions lends itself to being machined by standard tooling and equipment which is not possible with other high cobalt content alloys or alloys which develop primary carbides.

It is a further object of the present invention to provide such an alloy which can be welded to surfaces, by the bulkweld process, by flux cored wire, in which electrodes can be cast and having a fluxing agent covering for use by shielded metal arc welding processes.

It is a further object of the present invention to provide such an alloy which has a tight crack pattern, that is one of 0.005 inch or which have a crack free or smooth surface.

It is a further object of the present invention to provide such an alloy which has a hardness on the Rockwell "C" scale ranging from 30 Rc to 52 Rc.

It is a further object of the present invention to provide such an alloy having good metal to metal wear characteristics and which has a lower coefficient friction than the current cobalt based alloy, such as Stellite 1 and Stellite 6.

It is a further object of the present invention to provide such an alloy that at elevated temperature, i.e. 1400°–1600° F., the alloy composition has diamond point hardness readings in the range of 225–260 and 120–200, respectively.

It is a further object of the present invention to provide such an alloy which when welded to a surface does not form stress cracks upon cooling.

Other and further objects, features, and advantages of the present invention appear throughout the specification and claims or are inherent therein.

DESCRIPTION OF PRESENTLY PREFERRED EMBODIMENTS

The alloy of the present invention is an iron based and fully austenitic alloy comprising from about 38.0 to about 62.0 percent by weight alloy elements, and preferably about 42–44 percent by weight alloy elements, that include chromium, nickel, molybdenum, manganese, silicon, carbon and a reduced amount of cobalt, that is, from about 3 percent to about 9 percent by weight. The alloy has a hardness reading on the Rockwell "C" scale ranging from about 30 Rc to about 52 Rc. The alloy of the present invention has good metal to metal wear characteristics and provides a lower coefficient of friction than do current cobalt based alloys, such as Stellite 1 and Stellite 6. At elevated temperatures, i.e. 1400°–1600° F., this alloy composition has a diamond point hardness reading in the range of from about 225 to 260 and 120 to 200, respectively.

As previously mentioned, the alloy of the present invention is weldable over existing cobalt based alloys, and it is machinable using standard machine processes which is not possible with other cobalt alloys, such as Stellite 1 and Stellite 6, because this alloy does not develop primary carbides which are not machinable by normal methods and procedures.

The alloy when deposited has a tight crack pattern, that is, >0.005 inch and if desired, it can be crack free with a smooth surface. The alloy does not stress crack on cooling which is a benefit in providing sealing surfaces, such as butterfly valve seats and discs.

As previously mentioned, the preferred method of manufacture utilizes the bulkweld processes where an alloy powder and wire are melted together in a welding arc and simultaneously welded to a base plate while melting an amount of base plate to obtain a weld bond, such as set forth in the patents previously mentioned. If desired, a flux cored wire having a sufficient powder chemistry within a metal core can also be used. Cast electrodes can also be used having a fluxing agent covering for use by shielded metal arc welding process, commonly referred to as SMAW. Also, complete parts may be cast of the alloy of the present invention.

The alloy of the present invention has high erosion qualities which render it suitable for use as a material for internal parts of slide, gate, butterfly, and other control valves. It can be used in protecting parts from erosion at elevated temperatures, such as that found in fluidized catalytic cracking units. Also, the alloy is suitable for protecting valve parts such as guides, discs, liners, orifice plates, as well as the valve body itself. The alloy also has beneficial qualities which lend itself well to the protection of other parts such as air grid nozzles, thermowells used for protection against erosion of pressure and temperature measuring instruments, which are currently and normally protected by cobalt based alloys, such as Stellite 1 and Stellite 6.

Other uses of the alloy include those in nuclear power generating stations where this alloy has the advantage of having a lower cobalt content than alloys currently being in use, in hydroelectric plants also where high cobalt content alloys are currently used to protect equipment from cavitational wear.

The following are representative specific examples of alloys according to the invention which have the foregoing properties. All percentages are by weight.

EXAMPLE 1

| Chemical Composition | |
|---|---|
| Carbon | .047 |
| Manganese | 1.18 |
| Silicon | 2.76 |
| Chromium | 21.18 |
| Molybdenum | 8.23 |
| Nickel | 8.98 |
| Cobalt | 5.16 |
| Iron balance (including incidental impurities) | |

In this example, the alloy content was about 42 percent, it had a smooth surface, good tie in qualities, and did not stress or crack upon cooling. This alloy had a measured hardness (HRc) 1/16 inch below the surface of 46.5, 46.0, and 46.0.

The alloy was applied as a hardfacing by submerged arc, 3/32 inch diameter electrode, with a one to one powder to wire ratio. The oscillation width was 1⅜ inches, the oscillation frequency was 50 osc./per minute, and the electrodes stick out was 1 inch to 1½ inch. The alloy was welded utilizing 450 amps, 33 volts, and the travel speed was 8 inches per minute.

The above hardfacing alloy in addition to having the properties mentioned before provides a good mating surface for valve guides and disc where elevated temperatures are encountered. This hardfacing alloy had a hardness greater than Stellite 1 and Stellite 6 and had a good hot hardness from 70° F. up to 1600° F. It also had a lower friction coefficient, lower metal to metal wear loss, and a lower erosion loss than Stellite 1 and Stellite 6.

| Chemical Analysis | |
|---|---|
| Carbon | 0.038 |
| Sulphur | 0.006 |
| Phosphorus | 0.014 |
| Manganese | 1.10 |
| Silicon | 1.63 |
| Chromium | 20.26 |
| Molybdenum | 7.28 |
| Nickel | 9.52 |
| Vanadium | .11 |
| Titanium | .01 |
| Niobium | .03 |
| Tungsten | .02 |
| Cobalt | 3.92 |
| Iron balance (including incidental impurities) | |

This alloy had a hardness (HRc); top 23.0, 25.0, 26.5, and 23.0; 1/16 inch below the surface 30.0, 30.5, 31.0, 29.5, and at the fusion line 23.0, 25.0, 26.5, 23.0.

This alloy had the properties previously mentioned.

EXAMPLE 3

| | Hardness (DPH Scale) at Temperature (Fahrenheit) | | | | | |
|---|---|---|---|---|---|---|
| | 70° | 800° | 1000° | 1200° | 1400° | 1600° |
| Alloy of Example 1 | 523 | 413 | 401 | 359 | 252 | 140 |
| Stellite 1 (Published Data) | NA | 510 | 465 | 390 | 230 | (187 Actual) |
| Stellite 6 (Published Data) | NA | 300 | 275 | 260 | 185 | (90 Actual) |

EXAMPLE 4

| Friction Coefficiency | |
|---|---|
| Alloy of Example 1 | 0.373 |
| Stellite 1 | 0.518 |
| Stellite 6 | 0.770 |

The test specimens were single layer deposits on an iron base plate using a flux core welding process.

EXAMPLE 5

| Metal to Metal Wear Loss (Ball on Disc) | |
|---|---|
| | Mass Change (gms) |
| Alloy of Example 1 | −0.1772 |
| Stellite 1 | −0.0750 |
| Stellite 6 | −0.2382 |
| Test Duration | 60 minutes |
| Specimen Load | 25 pounds |
| Temperature | Ambient |
| RPM | 300 |

EXAMPLE 6

Erosion Loss of Hardfacings due to High Velocity Low Energy Abrasion

Tests were performed on three samples of hardfacing used in slide valves. The testing was done using a modified ASTM C-704 Erosion Tester. The normal test time of 7.5 minutes was changed to 15 minutes, and the abrasive media was increased from 1000 grams to 2000 gms. This was done to obtain a sufficient weight loss of each sample for comparison purposes.

| | | |
|---|---|---|
| Alloy of Example 1: | | |
| As welded hardness | 47.3 | Rc |
| Starting Weight | 1926.68 | gms. |
| Finish Weight | 1925.82 | gms. |
| Weight Loss | .86 | gms. |

-continued

| | | |
|---|---|---|
| Volume Loss- | .00856 | cu. in. |
| Alloy of Stellite 1: | | |
| As welded hardness | 50.9 | Rc |
| Starting Weight | 1742.16 | gms. |
| Finish Weight | 1740.73 | gms. |
| Weight Loss | 1.43 | gms. |
| Volume Loss- | .01424 | cu. in. |
| Alloy of Stellite 6: | | |
| As welded hardness | 40.1 | Rc |
| Starting Weight | 1722.83 | gms. |
| Finish Weight | 1721.68 | gms. |
| Weight Loss | 1.15 | gms. |
| Volume Loss- | .01145 | cu. in. |

EXAMPLE 7

In this example, the amount of the alloying elements varied from 32.0 to 62.0 per cent by weight, and the specific alloying elements varied in the amounts previously set forth. The resulting alloy has the properties previously mentioned.

The present invention, therefore, is well suited and adapted to attain the objects and ends and has the advantages and features mentioned above as well as others inherent therein.

While presently preferred embodiments of the invention have been given for the purposes of disclosure, changes can be made within the spirit of the invention as defined by the scope of the appended claims.

What is claimed is:

1. An iron based austenitic alloy including about 38 to about 62 percent by weight alloy elements comprising 0.02 to 0.80 carbon, having an alloy content of 20.00 to 30.00 percent chromium, 7.00 to 9.00 percent nickel, 5.00 to 9.00 percent molybdenum, 3.00 to 9.00 percent cobalt, and 0.50 to 3.00 percent manganese by weight.

2. An iron based austenitic alloy including about 42 to about 44 percent by weight alloy elements comprising 0.02 to 0.80 carbon, having an alloy content of 20.00 to 30.00 percent chromium, 7.00 to 9.00 percent nickel, 5.00 to 9.00 percent molybdenum, 3.00 to 9.00 percent cobalt, and 0.50 to 3.00 percent manganese by weight.

* * * * *